US006332950B1

(12) United States Patent
Snekkenes et al.

(10) Patent No.: US 6,332,950 B1
(45) Date of Patent: Dec. 25, 2001

(54) METHOD IN CONNECTION WITH THE PRETREATMENT OF COMMINUTED FIBROUS MATERIAL

(75) Inventors: Vidar Snekkenes; Lennart Gustavsson, both of Karlstad (SE)

(73) Assignee: Kaverner Pulping AB (SE)

( * ) Notice: Subject to any disclaimer, the term of this patent is extended or adjusted under 35 U.S.C. 154(b) by 0 days.

(21) Appl. No.: 09/446,272

(22) PCT Filed: Jun. 25, 1997

(86) PCT No.: PCT/SE97/01135

§ 371 Date: Dec. 17, 1999

§ 102(e) Date: Dec. 17, 1999

(87) PCT Pub. No.: WO98/59107

PCT Pub. Date: Dec. 30, 1998

(51) Int. Cl.[7] ..... D21C 7/14

(52) U.S. Cl. ..... 162/41; 162/42; 162/43; 162/47

(58) Field of Search ..... 162/17, 18, 52, 162/238, 239, 246, 248, 41, 42, 43, 46, 47

(56) References Cited

U.S. PATENT DOCUMENTS 3,425,898 * 2/1969 Laakso ..... 162/19
5,476,572 * 12/1995 Prough ..... 162/246
5,736,006 * 4/1998 Prough ..... 162/52

FOREIGN PATENT DOCUMENTS

WO 95/34712 12/1995 (WO) .
WO 97/03243 1/1997 (WO) .
WO97/03244 * 1/1997 (WO) .

* cited by examiner

*Primary Examiner*—Dean T. Nguyen
(74) *Attorney, Agent, or Firm*—Fasth Law Offices; Rath Fasth

(57) ABSTRACT

A method in connection with the pretreatment of comminuted fibrous material intended for chemical cellulose pulp production. The fibrous material is fed through a low pressure system that has a gas phase part followed by a liquid phase part. The liquid phase part includes a low pressure circulation where a circulating liquid is withdrawn from the fibrous material and recirculated back to the fibrous material in an upstream position. The fibrous material is sluiced into a high pressure system that has a liquid phase transfer part operatively connected to a digester. A hot process liquid and/or the circulating liquid are evaporatively cooled by being allowed to flash within the low pressure system.

16 Claims, 1 Drawing Sheet

METHOD IN CONNECTION WITH THE PRETREATMENT OF COMMINUTED FIBROUS MATERIAL

TECHNICAL FIELD

The present invention relates to a method in connection with the pretreatment, that is steaming and impregnation, of comminuted fibrous material that is intended for use in cellulose production by chemical methods, for example kraft cellulose production.

BACKGROUND AND SUMMARY OF THE INVENTION

In the production of cellulose pulp from comminuted fibrous material, preferably wood chips, by chemical methods, for example kraft cooking, there is a need to pretreat the material before the cooking in order to drive out gas and vapour from the cavities inside the wood chips and replace it with a liquid at the same time as the chips are heated.

Conventional pretreatment processes normally include a chip bin from which the chips are fed via a low pressure feeder to low pressure system which comprises a steaming vessel followed by a chip chute. At the lower end of the chip chute there is optionally arranged a pump and thereafter a pressure sluice, a so called high pressure feeder, by aid of which the chips are introduced into a high pressure system. From the high pressure feeder there is also an outgoing line that establishes a liquid phase low pressure circulation together with a pump, a sand trap, a tubular strainer and a level tank. By this low pressure circulation, circulating liquid is transferred back to the fibrous material in an upstream position. The high pressure system includes a transfer circulation that transfers the chips, together with liquor, to the top of a digester or an impregnation vessel. A part of the liquor is separated from the chips at the top of the digester and transferred back to the high pressure feeder. The chips are cooked in the digester in an upper concurrent zone followed by a lower countercurrent zone. An extraction screen section is arranged between these zones. Hot black liquor is extracted from this screen section and led to a flash tank, which is usually coupled in series with a second flash tank. The steam phase from the flash tanks is usually used as a direct heat source in said chip bin and/or steaming vessel. There is a need to cool (by means of cold white liquor or separate cooling with cold water) the liquor in the return line of the transfer circulation and/or the circulating liquid in the low pressure circulation in order to avoid flashing and resulting bangs in the high pressure feeder.

From U.S. Pat. No. 5,053,108 there is known a process where black liquor is led to the chip chute. This black liquor originates from the flash tanks and has hence been cooled through the pressure release in the flash tanks.

In a conventional system there is a potential to enhance the heat economy to an extent which has not been fully done in the past.

The object of the present invention is to provide an improved method in connection with the pretreatment of comminuted fibrous material, which method provides a way to avoid bangs in the high pressure feeder and also gives better heat economy and less equipment than conventional methods.

This is achieved by the method according to patent claim 1, which means that hot process liquid and/or circulating liquid in the low pressure circulation is evaporatively cooled by being allowed to flash within said low pressure system. Said hot process liquid is preferably uncooled before its entry into the low pressure system. The pressure of said hot process liquid is preferably essentially the same as in the high pressure system.

Normally, said low pressure system includes a low pressure circulation where liquid is withdrawn from said fibrous material and is recirculated back to said fibrous material in an upstream position. The conventional low pressure circulation comprises a level tank for pressure balancing against a gas phase part of the low pressure system, so that a liquor level (normally in the chip chute) between said gas phase part and said liquid phase part can be controlled and a liquid flow from said low pressure circulation can be stabilised. Said level tank is in the following included in the low pressure system and in the low pressure circulation, although the liquid which is formed in the bottom of the tank is normally withdrawn from the circulation and also although the saturation pressure at the temperature in the level tank may be lower than in the rest of the low pressure system. According to a further aspect of the invention said hot process liquid and/or said circulating liquid is allowed to flash into said level tank.

A further aspect of the invention is that steam is produced by said flashing and that this steam is used for direct heating of said fibrous material.

A further aspect of the invention is that said hot process liquid comprises black liquor.

Yet a further aspect of the invention is that said hot process liquid has a temperature of 100–180° C., preferably 110–170° C. and more preferably 120–160° C. and a pressure of 3–25 bar, preferably 4–20 bar and more preferably 5–15 bar.

According to a further aspect of the invention, the pressure in said low pressure system is 0.5–5 bar (abs), preferably 0.7–4 bar and more preferably 1–3 bar and the temperature is 60–145° C., preferably 80–130° C. and more preferably 90–120° C.

Yet a further aspect of the invention is that a liquid phase is formed in said level tank, which liquid is conveyed to said transfer circulation of the high pressure system in order to be further conveyed to the digester.

Another advantage of the method is that flashing with resulting bangs in the high pressure feeder can be avoided without the need of energy degrading cooling by cold water.

An advantage of the method according to the invention is that the live steam consumption can be reduced which results in an improved heat economy.

Another advantage is increased dryness of spent black liquor.

Another advantage is that less equipment is needed when performing the same process as in conventional systems.

DETAILED DESCRIPTION

Figure 1:
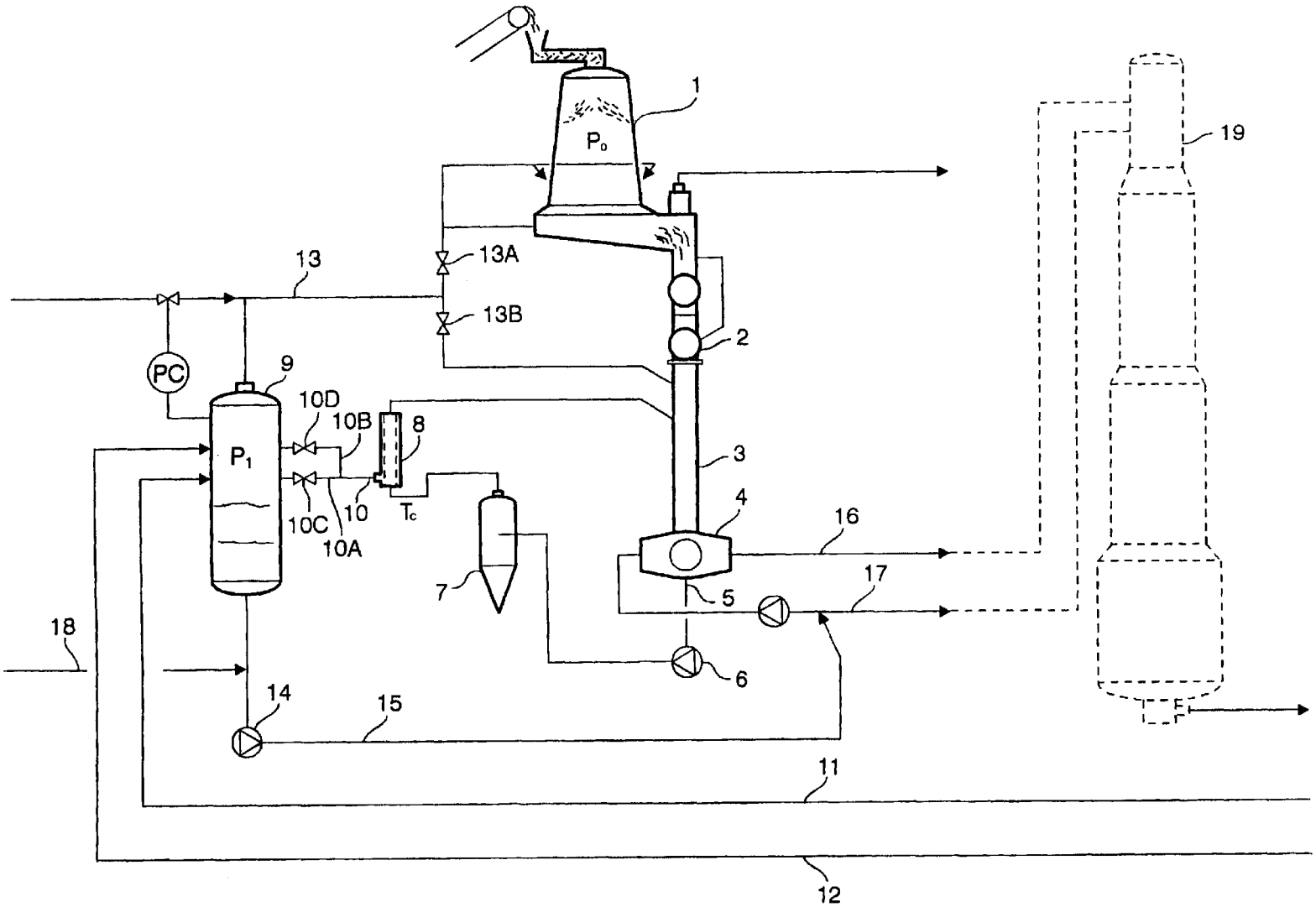
FIG. 1 is a schematic flow diagram for a continuous pretreatment of fibrous material according to the present invention.

The invention will be explained in greater detail hereinafter with reference to the drawing which is a diagrammatic representation of a preferred flow sheet for continuous pretreatment of fibrous material in accordance with the present invention.

In the drawing, the reference number (1) denotes a chip bin which may be atmospheric or operating at a minor overpressure. The wood chips are fed into the top of the chip bin and are treated therein in a gas phase with steam in order to heat the chips and to drive out gas from their internal cavities. After this treatment the chips are fed via a low pressure feeder (2) to a low pressure system which optionally comprises a steaming vessel (not shown) followed by a chip chute (3). In the chip chute the chips leave the gas phase part and enters a liquid phase part of the system. At the lower end of the chip chute there is arranged a pressure sluice, a so called high pressure feeder (4), by aid of which the chips are introduced into a high pressure system. From the high pressure feeder (4) there is also an outgoing line (5) that establishes a liquid phase low pressure circulation together with a pump (6), a sand trap (7), a tubular strainer which hereinafter is called an inline drainer (8) and a level tank (9). The low pressure liquor in line (5) is fed by the pump (6) into the sand trap (7), where sand is separated from the liquor, and further through the inline drainer (8) back into the chip chute (3). From the inline drainer there is also an outgoing line (10, 10B) via a valve (10D) to the level tank (9). The object of the level tank is conventionally only to act as a pressure balancing apparatus against said gas phase part of the low pressure system, so that a liquor level between said gas phase part and said liquid phase part can be controlled and a liquid flow from said low pressure circulation can be stabilised. In the present invention, the level tank however also acts as a flash tank. Hot, preferably uncooled, process liquid (11, 12), which may comprise black liquor, from the high pressure system is led into the level tank, above a liquor level. As a result of the released pressure, the liquid flashes into steam and a colder liquid. The steam is, according to the invention, led in a line (13), optionally together with live low pressure steam, through a valve (13A), to the chip bin (1), where it is used for direct heating of the wood chips. Liquid from the level tank (9) is pumped (14) together with an incoming cold process liquid (18), which preferably consists of white liquor, to the high pressure system. The high pressure system includes a transfer circulation with a feed line (16), that transfers the chips, together with liquor, to the top of a digester (19). A part of the liquor is separated from the chips at the top of the digester and transferred back to the high pressure feeder through a return line (17). The chips are cooked in the digester in an upper concurrent zone followed by a lower countercurrent zone. An extraction screen section (not shown) is arranged between these zones. Hot black liquor is extracted from this screen section.

In the above described, first embodiment of the invention, the saturation pressure $P_9$ at the temperature in the level tank is approximately the same as the pressure $P_1$ in the chip bin. The saturation pressure $P_{11}$ (and $P_{12}$) at the temperature of the hot process liquid (11, 12) is, however substantially higher than $P_1$ and $P_9$. For this reason, the hot process liquid flashes into the level tank (9). The saturation pressure $P_8$ at the temperature in the inline drainer is also higher than $P_9$, which results in a flashing and cooling also of the liquid that is led into the level tank via the line (10B) that mouths above the liquid level in the level tank.

In a second embodiment, which does not include flashing of the hot process liquid, it is merely the liquid from the inline drainer (8) that is led into the level tank via the line (10B) that mouths above the liquid level in the level tank. This embodiment provides a beneficial way to cool the liquid within the low pressure circulation.

In a third embodiment, the steam from the level tank is led in line (13), through a valve (13B), into the chip chute (3). In this case, there is not an open connection between the level tank and the chip bin and hence $P_9$ is higher than $P_1$ but still lower than $P_{11}$ ($P_{12}$). $P_8$ is, however, approximately the same as $P_9$ and the liquid from the inline drainer is thus led in a line (10, 10A) through a valve (10C) into the level tank (9) under the liquid level. No flashing of the liquid from the inline drainer takes place.

The two different embodiments can suitably be implemented in a manner so that either alternative can be operated in the same mill. If the first or second mentioned embodiments are wished, the valves (13A) and (10D) are open and (13B) and (10D) are closed. If the third embodiment is wished, the valves (13B) and (10D) are open and (13A) and (10D) are closed.

The invention is not delimited by the above mentioned description and embodiments, but can be varied within the scope of the claims. The skilled man will for instance realise that the same effect can be achieved by flashing into another vessel within the low pressure system. Also, the steam from the flashing can be led to condensers instead of the chip bin. Moreover, the combination of the possibilites to open or shut the valves are numerous. Although the drawing shows a certain type of equipment in the low and high pressure systems, it is of course possible to implement the invention in both older and newer systems. There can, for instance, be an impregnation vessel before the digester, in which case the chips are transferred from the high pressure feeder to the impregnation vessel and subsequently to the digester.

While the present invention has been described in accordance with preferred compositions and embodiments, it is to be understood that certain substitutions and alterations may be made thereto without departing from the spirit and scope of the following claims.

We claim:

1. A method in connection with the pretreatment of comminuted fibrous material for chemical cellulose pulp production, comprising:

(a) feeding the comminuted fibrous material through a low pressure system, the low pressure system comprising a gas phase portion followed by a liquid phase portion, the liquid phase portion having a low pressure circulation, the low pressure circulation comprising a level tank;

(b) withdrawing a circulating liquid from the fibrous material flowing at a withdrawal point in the low pressure circulation;

(c) recirculating the circulating liquid back to the fibrous material at a recirculating point that is upstream of the withdrawal point;

(d) balancing a pressure in the level tank against a pressure in the gas phase portion of the low pressure system to control a liquor level between the gas phase portion and the liquid phase portion;

(e) stabilizing a liquid flow from the low pressure circulation;

(f) sluicing the fibrous material into a high pressure system of a digester comprising a liquid phase transfer portion being operatively connected to a digester;

(g) providing a hot process liquid having a pressure that is the same as a pressure of the high pressure system, the pressure of the high pressure system being greater than a pressure of the low pressure system;

(h) leading the hot process liquid from the high pressure system directly into the level tank above a tank liquor level; and (i) evaporatively cooling the hot process liquid from the high pressure system by allowing the hot process liquid to flash above the tank liquor level inside the level tank.

2. The method according to claim 1 wherein the method further comprises producing steam and using the steam to directly heat the fibrous material.

3. The method according to claim 1 wherein the method further comprises providing the hot process liquid with a black liquor.

4. The method according to claim 1 wherein the method further comprises providing the hot process liquid with a temperature of between about 100° C. and 180° C.

5. The method according to claim 1 wherein the method further comprises providing the hot process liquid with a temperature of between about 110° C. and 170° C.

6. The method according to claim 1 wherein the method further comprises providing the hot process liquid with a temperature of between about 120° C. and 160° C.

7. The method according to claim 1 wherein the method further comprises providing the hot process liquid with a pressure of between about 3 bar and 25 bar.

8. The method according to claim 1 wherein the method further comprises providing the hot process liquid with a pressure of between about 4 bar and 20 bar.

9. The method according to claim 1 wherein the method further comprises providing the hot process liquid with a pressure of between about 5 bar and 15 bar.

10. The method according to claim 1 wherein the method further comprises providing the low pressure system with a pressure of between about 0.5 bar and 5 bar.

11. The method according to claim 1 wherein the method further comprises providing the low pressure system with a pressure of between about 0.7 bar and 4 bar.

12. The method according to claim 1 wherein the method further comprises providing the low pressure system with a pressure of between about 1 bar and 3 bar.

13. The method according to claim 1 wherein the method further comprises providing the low pressure system with a temperature of between about 60° C. and 145° C.

14. The method according to claim 1 wherein the method further comprises providing the low pressure system with a temperature of between about 80° C. and 130° C.

15. The method according to claim 1 wherein the method further comprises providing the low pressure system with a temperature of between about 90° C. and 120° C.

16. The method according to claim 1 wherein the method further comprises forming a liquid phase in the level tank, conveying the liquid phase formed in the level tank to the liquid phase transfer portion of the high pressure system and conveying the liquid phase to the digester.

* * * * *